US011208873B2

(12) United States Patent
Sullivan

(10) Patent No.: US 11,208,873 B2
(45) Date of Patent: Dec. 28, 2021

(54) SWITCH SUB WITH TWO WAY SEALING FEATURES AND METHOD

(71) Applicant: Bakken Ball Retrieval LLC, Minot, ND (US)

(72) Inventor: Shelby Lee Sullivan, Minot, ND (US)

(73) Assignee: Bakken Ball Retrieval LLC, Minot, ND (US)

( * ) Notice: Subject to any disclaimer, the term of this patent is extended or adjusted under 35 U.S.C. 154(b) by 13 days.

(21) Appl. No.: 15/808,290

(22) Filed: Nov. 9, 2017

(65) Prior Publication Data

US 2018/0135389 A1 May 17, 2018

Related U.S. Application Data

(60) Provisional application No. 62/423,648, filed on Nov. 17, 2016.

(51) Int. Cl.
*E21B 43/119* (2006.01)
*E21B 17/042* (2006.01)
*E21B 43/117* (2006.01)

(52) U.S. Cl.
CPC ..... *E21B 43/119* (2013.01); *E21B 17/042* (2013.01); *E21B 43/117* (2013.01)

(58) Field of Classification Search
CPC ..... E21B 43/1185–11857
See application file for complete search history.

(56) References Cited

U.S. PATENT DOCUMENTS 2,029,490 A * 2/1936 Lane ..... E21B 43/116 175/4.54
2,062,974 A * 12/1936 Lane ..... E21B 43/116 175/4.55
2,264,450 A * 12/1941 Mounce ..... E21B 43/1185 175/4.54
2,331,058 A * 10/1943 Stick, Jr. ..... E21B 43/1185 175/4.55
2,621,732 A * 12/1952 Ahlgren ..... E21B 43/116 175/4.55
3,032,107 A * 5/1962 Hoyer ..... E21B 43/119 175/4.51
3,126,964 A * 3/1964 La Rue ..... F42D 1/05 175/4.55
3,246,707 A * 4/1966 Bell ..... F42D 1/05 175/4.54
3,528,511 A * 9/1970 Joe ..... E21B 43/116 175/4.55
3,528,512 A * 9/1970 Joe ..... E21B 43/116 175/4.55

(Continued)

*Primary Examiner* — Steven A MacDonald
(74) *Attorney, Agent, or Firm* — Peter L. Brewer; Thrive IP

(57) ABSTRACT

A switch sub adapter configured to connect a switch sub to a perforating gun assembly. The switch sub adapter includes a tubular body having first threads that connect to the switch sub and second threads that connect to the perforating gun assembly; a first internal chamber formed at a first end of the adapter; a second internal chamber formed at a second end of the adapter; a conduit connecting the first internal chamber to the second internal chamber; and a dart having a tip located in the conduit and a base part located in the second internal chamber. The dart is formed from a compliant material that deforms in response to pressure resulting from detonation of charges associated with the perforating gun.

8 Claims, 10 Drawing Sheets

(56) References Cited

U.S. PATENT DOCUMENTS

| | | | | | |
|---|---|---|---|---|---|
| 3,648,785 | A * | 3/1972 | Walker | E21B 43/1185 | 175/4.54 |
| 3,695,368 | A * | 10/1972 | Lanmon, II | E21B 43/117 | 175/4.52 |
| 4,089,381 | A * | 5/1978 | Hallmark | E21B 43/117 | 102/310 |
| 4,164,886 | A * | 8/1979 | Hallmark | E21B 43/1185 | 102/310 |
| 5,042,594 | A * | 8/1991 | Gonzalez | E21B 43/1185 | 175/4.55 |
| 5,531,164 | A * | 7/1996 | Mosley | E21B 43/1185 | 102/202.12 |
| 9,080,433 | B2 * | 7/2015 | Lanclos | E21B 43/1185 | |
| 10,184,331 | B2 * | 1/2019 | Mace | F23Q 21/00 | |
| 2011/0271823 | A1 * | 11/2011 | Vicente | F42D 1/05 | 89/1.15 |
| 2012/0199031 | A1 * | 8/2012 | Lanclos | E21B 43/1185 | 102/206 |
| 2012/0199352 | A1 * | 8/2012 | Lanclos | F42D 1/05 | 166/297 |
| 2012/0247769 | A1 * | 10/2012 | Schacherer | E21B 43/117 | 166/297 |
| 2013/0126237 | A1 * | 5/2013 | Burton | E21B 43/1185 | 175/2 |
| 2014/0338552 | A1 * | 11/2014 | Mace | E21B 43/263 | 102/215 |
| 2015/0000509 | A1 * | 1/2015 | Current | E21B 43/11 | 89/1.15 |

* cited by examiner

SWITCH SUB WITH TWO WAY SEALING FEATURES AND METHOD

STATEMENT OF RELATED APPLICATIONS

The present application claims the benefit of U.S. Ser. No. 62/423,648 filed Nov. 17, 2016.

TECHNICAL FIELD OF THE INVENTION

Embodiments of the subject matter disclosed herein generally relate to downhole tools related to perforating and/or fracturing operations, and more specifically, to a switch sub that protects the electronics located inside the switch sub from detonation debris, wellbore fluid, and/or a pressure wave produced by the detonation of a perforating gun assembly.

DISCUSSION OF THE BACKGROUND

In the oil and gas field, after a well 100 is drilled to a desired depth H relative to the surface 110, as illustrated in FIG. 1, and the casing 102 protecting the wellbore 104 has been installed and cemented in place, it is time to connect the wellbore 104 to the subterranean formation 106 to extract the oil and/or gas. This process of connecting the wellbore to the subterranean formation may include a step of plugging the well with a plug 112 and a step of perforating the casing with a perforating gun assembly 114, for making holes 116 into the casing.

The step of perforating the well requires lowering the perforating gun assembly 114 into the well 100, which is electrically and mechanically connected at one end to a wireline 118. The other end of the perforating gun assembly 114 is connected to a setting tool 120. The setting tool is configured to hold the plug 112 and to set the plug at the desired location, when instructed. FIG. 1 shows the setting tool 120 disconnected from the plug 112, indicating that the plug has been set in the casing and the setting tool 120 has been disconnected from the plug 112.

FIG. 1 shows the wireline 118, which includes at least one electrical connector, being connected to a control interface 122, located at the surface 110. An operator of the control interface 122 may send electrical signals to the perforating gun assembly 114 for detonating the shaped charges, for making the holes 116 into the casing 102. After the casing 102 has been perforated and at least one plug 112 has been set, the setting tool 120 and the perforating gun assembly 114 are taken out of the well 100 and a ball (not shown) is typically inserted into the wellbore 100 to fully close the plug 112. When the plug 112 is closed, a fluid 124, (e.g., water, water and sand, fracturing fluid, etc.) may be pumped by a pumping system 126, down the wellbore 100 for fracturing purposes.

The above operations may be repeated multiple times for perforating and/or fracturing the casing 102 at multiple locations, corresponding to different stages of the well. Note that in this case, multiple plugs 112 and 112' may be used for isolating the respective stages from each other during the perforating phase and/or fracturing phase.

During fracturing or other completion operations, it is desired to completely shut down one or more stages of the well. This is achieved by installing one or more plugs, e.g., 112, 112'. For each stage, a corresponding part of the casing 102 needs to be perforated before the fracturing operations. One or more perforating gun assemblies 114 may be used for each stage for perforating the casing 102.

If plural gun assemblies 114 are used, as illustrated in FIG. 2, a switch sub 230 is used to connect two adjacent perforating gun assemblies 214 and 214' to each other. An electronic switch 232 is located inside the switch sub 230 and the switch is electrically connected, e.g., through wire 234 to the wireline (shown at 114 in FIG. 1) for receiving detonation signals. Another wire 236 may connect the switch 232 to the perforating gun assembly 114. When a detonation signal is received from the wireline 118, the switch 232 sends a corresponding signal through the wire 234 to another device (e.g., an igniter, which is not shown in the figure) for activating a shaped charge 240 of the adjacent perforating gun assembly 214. FIG. 2 shows a simplified configuration in which wire 234 is connected to a shaped charge 240. One skilled in the art would understand that a detonator is likely to be connected to wire 234, and the detonator may detonate a detonator cord, which in turn detonates the shaped charges 240. However, as the detonation mechanism is not important for this application, the details of such mechanism are omitted.

In FIG. 2, the perforating gun assembly 214' is located downhole from the perforating gun assembly 214. When the detonation charge 240 is detonated, debris from the detonation, wellbore fluid, and/or a pressure wave enter the switch sub 230 and damage the switch 232. Thus, although the switch sub 230 is reusable after the detonation of all the perforating gun assemblies 214, 214', etc., the electronics inside the switch sub 230 is not. This means that when the system 114 is brought to the surface and prepared for another deployment, the electronics inside the switch sub 230 need to be replaced. Further, the inside chamber of the switch sub 230 needs to be cleaned. These steps are not only adding to the cost of the perforating operation, but are also slowing down the process.

Thus, it is desirable to have a switch sub that protects the inside electronics so that, after a perforating process is completed, both the switch sub and its electronics can be reused.

SUMMARY OF THE INVENTION

According to an embodiment, there is a switch sub adapter configured to connect a switch sub to a perforating gun assembly. The switch sub adapter includes a body having first threads that connect to the switch sub and second threads that connect to the perforating gun assembly; a first internal chamber formed at a first end of the adapter; a second internal chamber formed at a second end of the adapter; a conduit connecting the first internal chamber to the second internal chamber; and a dart having a tip located in the conduit and a base located in the second internal chamber.

According to another embodiment, there is a dart puck configured to close a switch sub. The dart puck includes a body having a conduit that communicates with an internal chamber, the conduit having a smaller diameter than the internal chamber; and a dart located with a tip part inside the conduit and with a base part inside the internal chamber. The dart is configured to seal the conduit so that a pressure wave generated on one side of the dart puck does not propagate through the conduit to another side of the dart puck.

According to still another embodiment, there is a switch sub configured to connect an upstream perforating gun assembly to a downstream perforating gun assembly. The switch sub includes a body having external threads, at a first end, which connect to the downstream perforating gun assembly, and external threads, at a second end, which connect to the upstream perforating gun assembly; an internal chamber; an electrical device located inside the internal chamber; a dart puck configured to close, at the second end, the internal chamber; and a dart located inside the dart puck and configured to seal the dart puck so that a pressure wave generated by the upstream perforating gun assembly does not propagate through the dart puck to damage the electrical device.

According to yet another embodiment, there is a method of using a switch sub that connects an upstream perforating gun assembly to a downstream perforating gun assembly. The method includes placing an electrical device inside a chamber of the switch sub; attaching the switch sub to the downstream perforating gun assembly; adding a sealing mechanism to one end of the chamber, the sealing mechanism having a dart that seals the chamber so that a pressure wave generated by the upstream perforating gun assembly does not propagate into the chamber to damage the electrical device; attaching the upstream perforating gun assembly to the switch sub; lowering the switch sub to a desired depth inside a well; and activating the upstream perforating gun assembly without damaging the electrical device.

According to another embodiment, there is a device for protecting an internal chamber of a switch sub from a blast of a perforating gun. The device includes a slab having a through passage and a projectile loosely located with a tip inside the passage and with a base outside the passage. The projectile is configured to seal the passage so that a pressure wave generated by detonation of a first perforating gun assembly located on one side of the slab does not propagate through the passage toward a second perforating gun assembly located on another side of the slab.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION OF CERTAIN EMBODIMENTS

Figure 1:
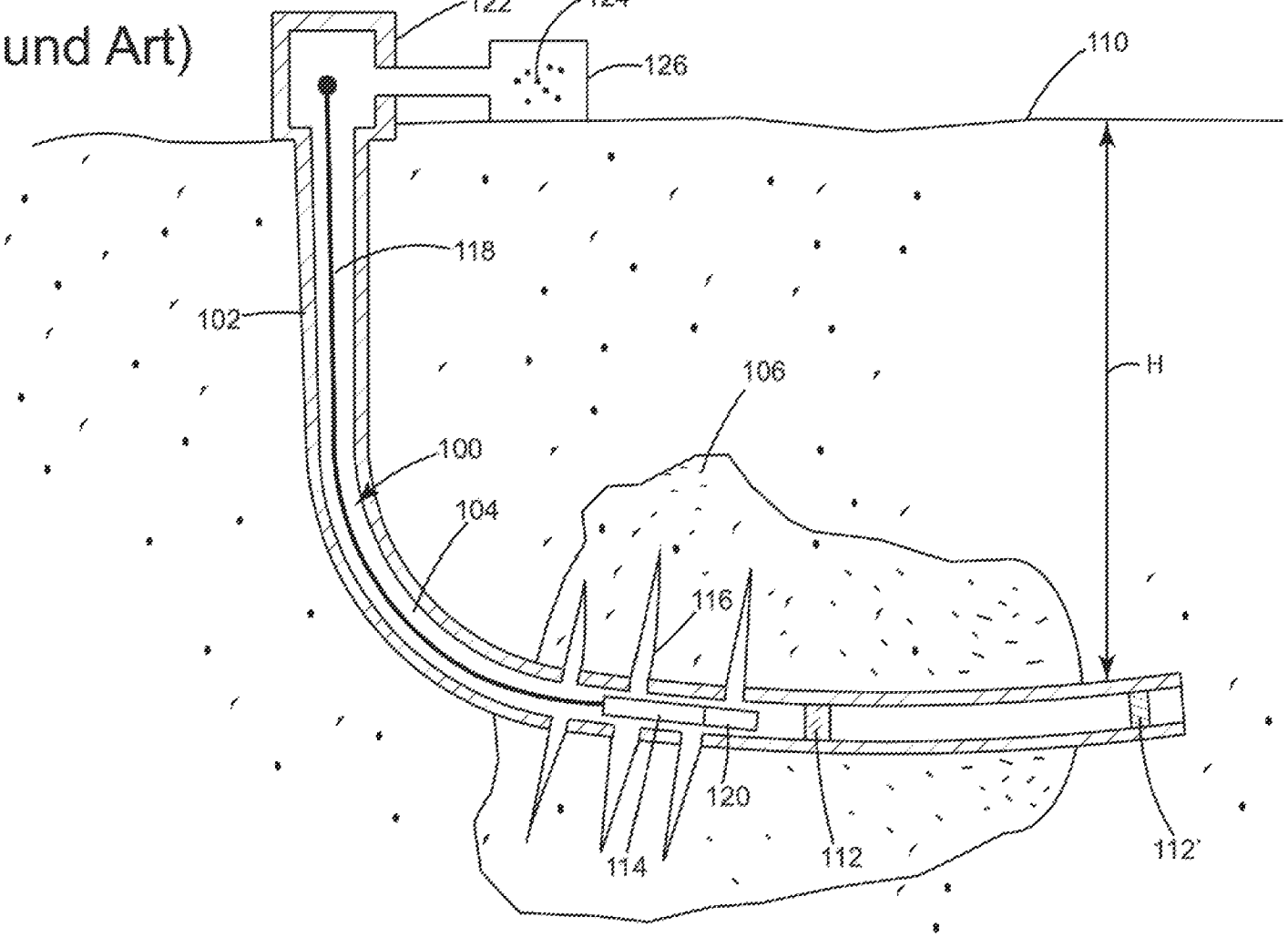
FIG. 1 (Background Art)
FIG. 1 illustrates a well and associated equipment for well completion operations.
Figure 2:
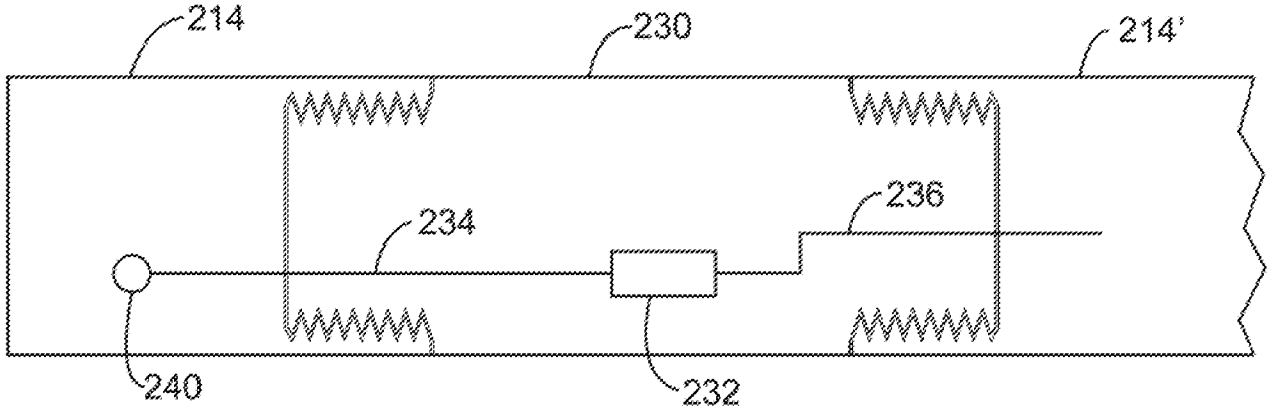
FIG. 2 illustrates end portions of two perforating gun assemblies connected to each other through opposing ends of a switch sub.

The following description of the embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to attaching two perforating gun assemblies to each other through a switch sub. In the following, the terms "upstream" and "downstream" are being used to indicate that one gun assembly may be situated above and below, respectively, in relation to a given element in the well. However, one skilled in the art would understand that the invention is not limited only to the upstream gun assembly or only to the downstream gun assembly, but in fact can be applied to either gun assembly. In other words, the terms "upstream" and "downstream" are not used in a restrictive manner, but only to indicate, in a specific embodiment, the relative positions of the gun assemblies. Further, the embodiments discussed herein are applicable to other components that need to be connected through a switch sub.

Reference throughout the specification to "one embodiment" or "an embodiment" means that a particular feature, structure or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

A typical switch sub is manufactured to have an internal chamber in which one or more electronic parts are located. The switch sub is designed to pressure seal one end of the internal chamber, from a downstream perforating gun assembly, so that the detonation of the shaped charges of the downstream perforating gun assembly do not damage the electronics. However, the internal chamber is not pressure sealed from the upstream perforating gun assembly. Thus, when a detonation signal is received from the wireline, the electronics inside the switch sub initiate the detonation of the upstream perforating gun assembly. After the shaped charged are detonated, the debris from the gun assembly, the wellbore fluid, and/or pressure wave produced by these detonations enter the internal chamber of the switch sub and damage the electronics. Thus, according to an embodiment, the switch sub is provided with a seal mechanism (e.g., adapter and dart or dart puck and dart) at the end facing the upstream perforating gun assembly, to pressure seal both ends of the internal chamber to protect the electronics inside. The term "puck" is used herein to mean an element having a certain surface that is used to cover an opening in a switch sub. The puck may have any shape and/or size as long as the features discussed later can be implemented in such element. The puck may be made of any appropriate material. For example, the puck may be a slab of metal. The term "dart" is used herein to mean an element that can partially enter inside a conduit formed in the puck. Under normal conditions, the dart can enter only partially inside the conduit. However, under increased pressure, the dart can deform and enter more inside the conduit. The dart may have any shape and/or size as long as it fulfils the features noted above. For example, the dart may be a projectile.

Figure 3:
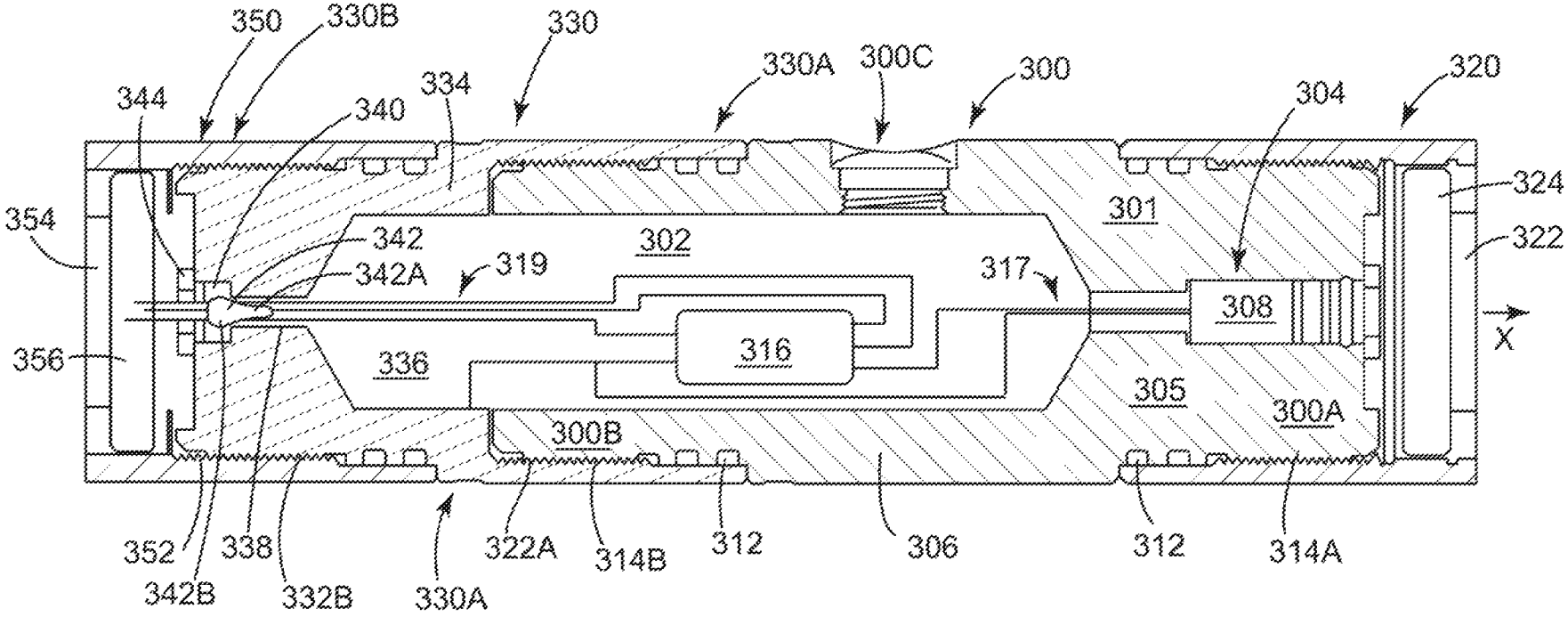
FIG. 3 illustrates a switch sub adapter that seals an end of a switch sub.

According to an embodiment illustrated in FIG. 3, a switch sub 300 has a body 301 extending between a first end 300A and a second end 300B, along a longitudinal axis X. The switch sub 300 is directly attached, through external threads 314A, at the first end 300A, to a downstream perforating gun assembly 320. However, the second end 300B of the switch sub 300, is not directly attached to an upstream perforating gun assembly 350, as traditionally implemented. A switch sub adapter 330 is mechanically connected (e.g., directly) between the second end 300B of the switch sub 300 and the upstream perforating gun assembly 350.

Figure 4:
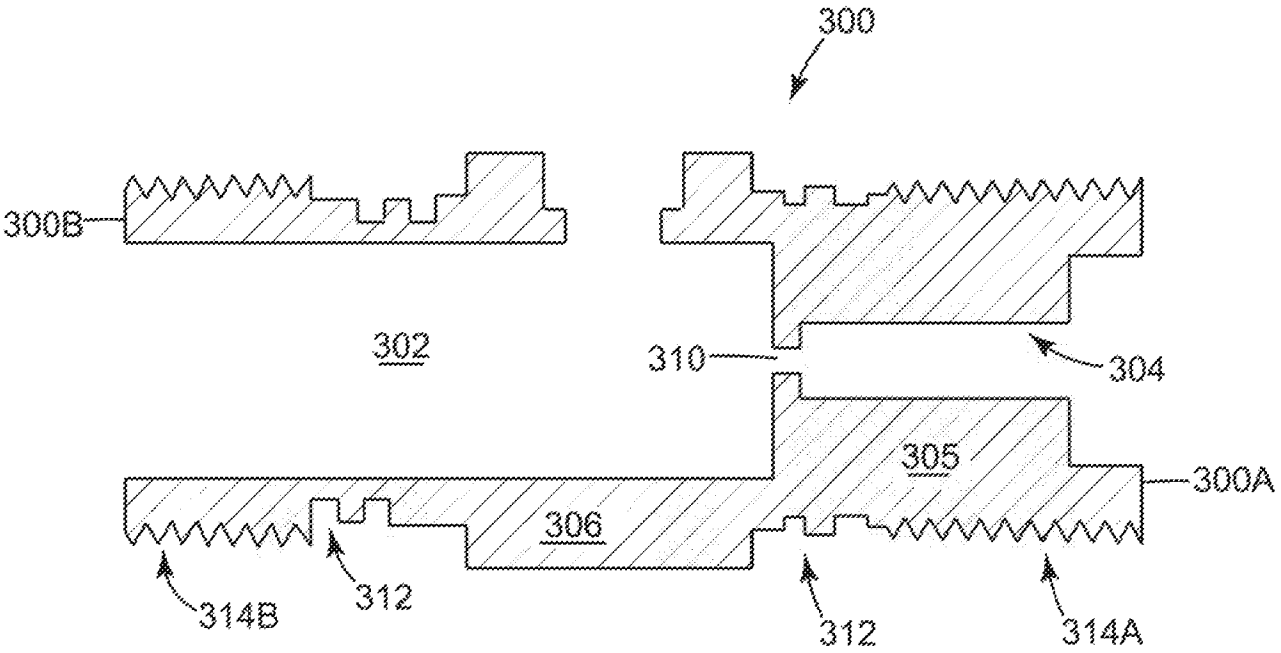
FIG. 4 illustrates a switch sub.

Switch sub 300 has an internal chamber 302 formed in a body 306. Chamber 302 is in communication, at the first end 300A, with a bore 304 formed in a bulkhead 305. While bore 304 is fully occupied by an igniter 308 (other devices may be present in the bulkhead instead of the igniter or no device) in FIG. 3, FIG. 4 shows the switch sub 300 with no igniter in the bore 304, for a better understanding of its structure. In this figure, a small conduit 310 connects the internal chamber 302 to the bore 304. Various grooves 312 may be formed at various locations along the external surface of the switch sub 300 for accommodating O-seals (not shown) for achieving a pressure seal between the perforating gun assemblies 320, 350 and the switch sub 300. For reasons related to the manufacturing of the switch sub 300, the end 300B of the body 306 has a large opening that communicates with the internal chamber 302.

The downstream perforating gun assembly 320 is attached to the switch sub 300 through corresponding threads 314A and the switch sub adapter 330 is attached to the switch sub 300 through corresponding threads 314B.

Returning to FIG. 3, switch sub adapter 330 attaches with threads 332A, located at a first end 330A of the adapter 330, to the corresponding threads 314B of the switch sub 300. Switch sub adapter 330 also attaches with threads 332B, located at a second end 330B of the adapter, to the corresponding threads 352 of the upstream perforating gun assembly 350. FIG. 3 also shows a gun carrier 322 and a corresponding end plate 324 of the gun carrier 322, both located inside the downstream perforating gun assembly 320, and a gun carrier 354 and a corresponding end plate 356 of the gun carrier 354, both located inside the upstream perforating gun assembly 350.

Inside the internal chamber 302 of the switch sub 300, there is a switch 316 that is electrically connected by one or more wires 317 to igniter 308 and by one or more wires 319 to the upstream perforating gun assembly 350. Switch sub 300 also has an opening 300C through which various electrical connections between the various wires may be made. A nut (not shown) may be attached (e.g., with threads) to opening 300C for sealing the internal chamber 302.

Figure 5:
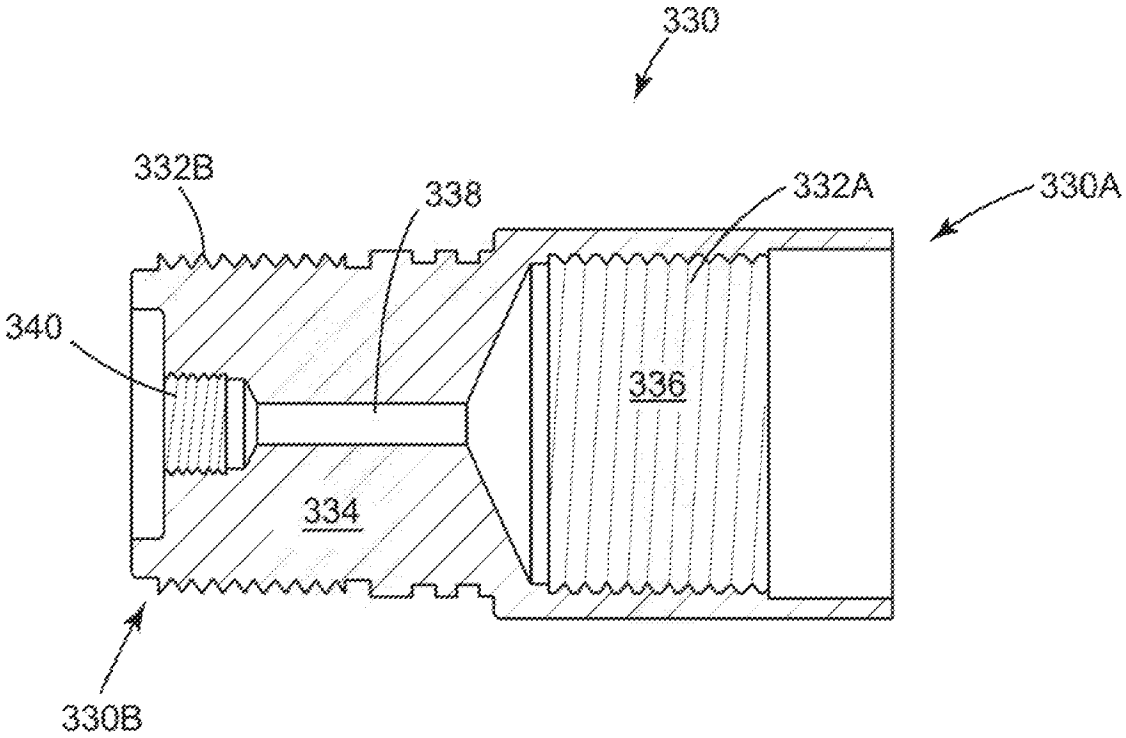
FIG. 5 illustrates the switch sub adapter.

Adapter 330 has a body 334 that houses an internal chamber 336, located at one end 330A of the adapter, and the internal chamber 336 is configured to communicate with the internal chamber 302 of the switch sub. In one application, internal chamber 336 and internal chamber 302 have the same internal diameter. Internal chamber 336 (called herein the first internal chamber) narrows toward the middle of the body 334, into a narrow conduit 338, as illustrated in more detail in FIG. 5. Conduit 338 continues to another internal chamber 340, called herein the second internal chamber, which is located at the second end 330B of the body 334.

Returning to FIG. 3, a dart 342 is loosely placed in the second internal chamber 340 so that, a narrow portion (or tip portion) 342A of the dart 342 is located partially inside the conduit 338 and the large portion (or base portion) 342B of the dart is located inside the second internal chamber 340. The one or more wires 319 extend from the internal chamber 302 of the switch sub 300 through the first internal chamber 336, conduit 338 and the second internal chamber 340 of the adapter 330, all the way into the upstream gun assembly 350. The one or more wires 319 extend along an exterior of the dart 342. A retaining nut 344, which is attached with threads to the second internal chamber 340, holds the dart 342 in place.

Figure 6B:
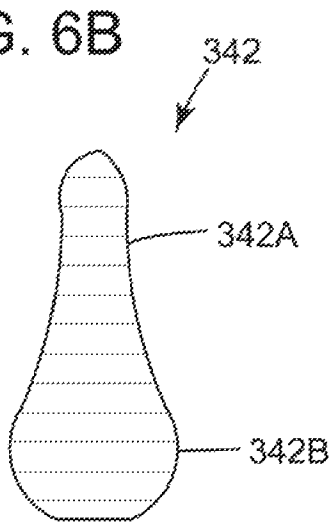
FIGS. 6A-6D illustrate a dart housed by a switch sub adapter and how the dart seals the switch sub adapter.
Figure 6A:
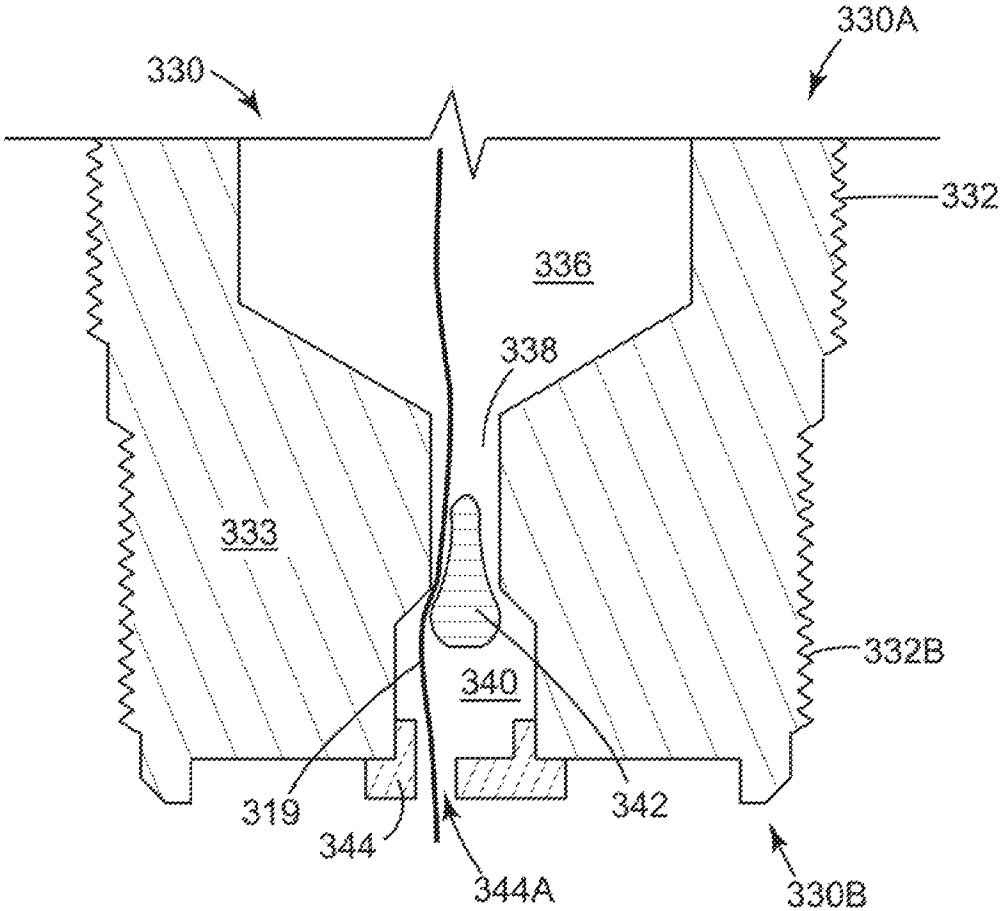

FIGS. 6A to 6D show in more detail the role played by the dart 342 while in the adaptor 330. FIG. 6A shows the dart 342 placed inside the second internal chamber 340 of the adapter 330, one or more wires 319 passing through conduit 338 into the internal chamber 340, past the dart 342. The retaining nut 344, which loosely holds the dart 342 inside the second internal chamber 340, is attached by threads to the body 334 of the adapter 330. Retaining nut 344 has a passage 344A that allows the one or more wires 319 to exit the second internal chamber 340 and to enter the upstream perforating gun assembly (shown at 350 in FIG. 3).

Dart 342 is shown in FIG. 6B as having a large part (base part) 342B and a narrow part (tip part) 342A. The tip 342A is configured to stay inside conduit 338. In other words, an external diameter of the tip 342A is smaller than a diameter of the conduit 338 while an external diameter of the base 342 is larger than the diameter of the conduit 338. The dart 342 is made of a soft metal (e.g., aluminum) which, when under a high pressure generated by the detonation of the shaped charges, enters the conduit 338 and partially deforms to seal the conduit 338.

Thus, when the upstream perforating gun assembly is detonated, a pressure blast from the gun enters into the second internal chamber 340, through the passage 344A, and pushes the dart 342 into the conduit 338. When this happens, the dart 342 is propelled into the conduit 338 as illustrated in FIG. 6C, severs the one or more wires 319, and seals the conduit 338 so that no debris or pressure waves enter inside the first chamber 336. In this way, the switch sub end 300B (shown in FIG. 3) is sealed and the electronics inside the switch sub 300 are protected from damage from the upstream perforating gun assembly 350. Note that due to the soft characteristic of the material from which the dart 342 is made, the dart 342 deforms to fully occupy a portion of the conduit 338. Although the one or more wires 319 are severed during this process, the integrity of the switch 316 (shown in FIG. 3) is preserved and thus, the switch 316 may be reused for another perforation operation.

Figure 6D:
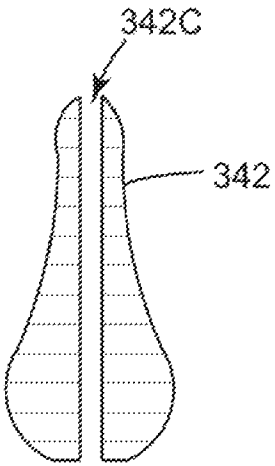
Figure 6C:
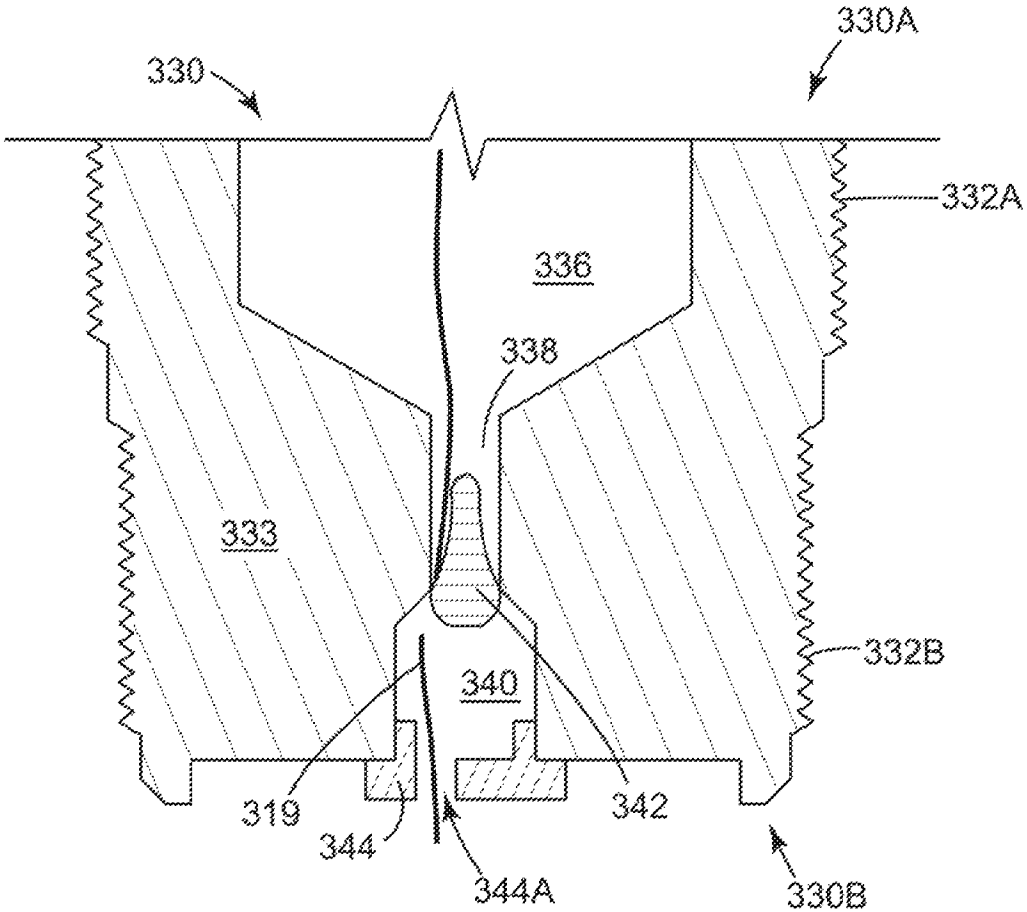

In one embodiment, the dart 342 may have an internal channel 342C, as illustrated in FIG. 6D, for allowing the one or more wires 319 to pass through. When the pressure wave from the upstream perforating gun assembly 350 pushes the dart 342 into conduit 338, due to the soft nature of the dart 342, the dart 342 deforms and closes the channel 342C, which may result or not in the severance of the one or more wires 319. Irrespective of whether the one or more wires 319 are severed during this process, the dart 342 seals conduit 338, thus, sealing the inside chamber 336 of the adapter 330 and the inside chamber 302 of the switch sub 300.

The embodiments discussed above have the advantage that the traditional switch subs can be used with the discussed adapter for protecting the switch or other electronics located inside the switch sub. However, the length of the entire assembly is increased, e.g., by about 4", due to the length of the adapter. For some situations, this result is undesired.

Figure 7A:
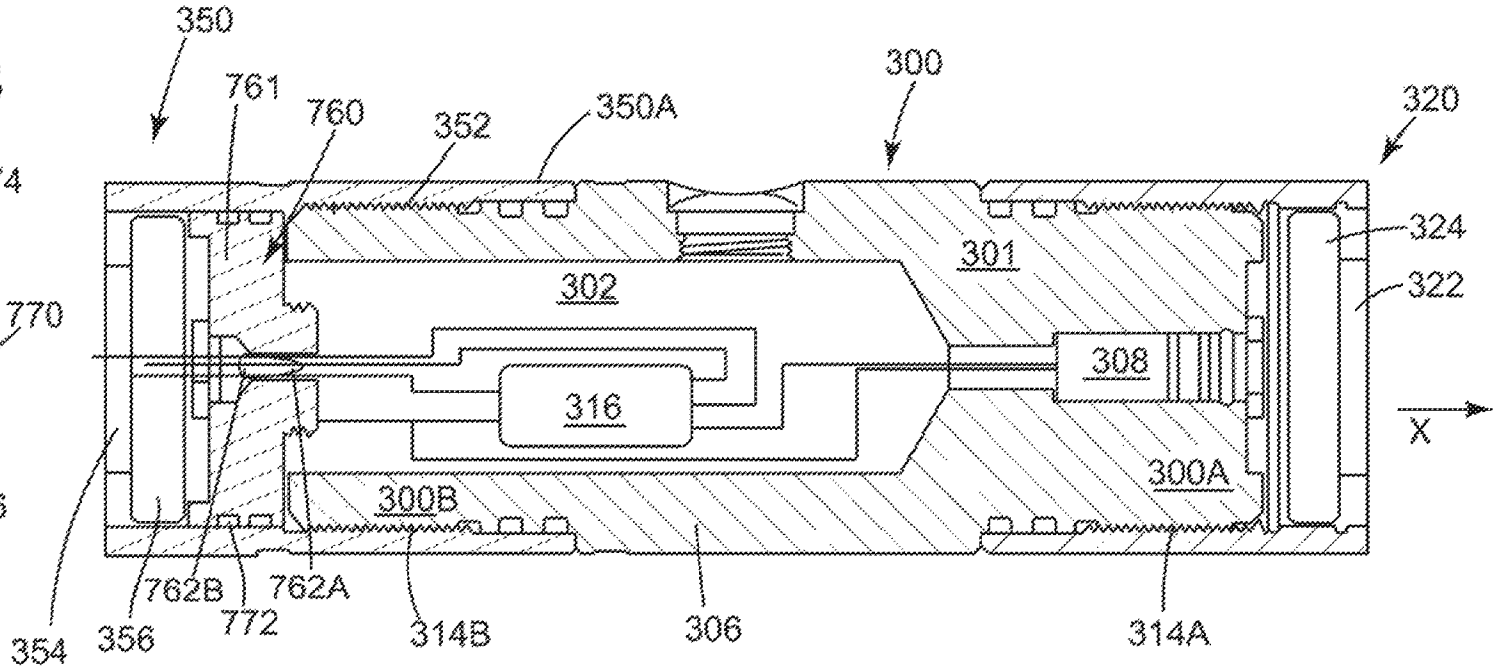
FIG. 7A illustrates a switch sub and a dart puck and FIG. 7B illustrates a dart located inside the dart puck.

Thus, another embodiment is now discussed that does not use the adapter 330 for sealing both ends of the switch sub. FIG. 7A shows the switch sub 300 being directly connected to the downstream perforating gun assembly 320 and to the upstream perforating gun assembly 350. For this embodiment, a dart puck 760 is located inside the upstream perforating gun assembly 350, in direct contact with the switch sub 300. To be able to accommodate the dart puck 760, the end 350A of the upstream perforating gun assembly 350 needs to be modified, i.e., to be made longer.

Figure 7B:
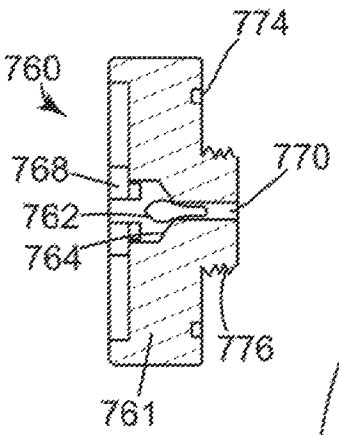

Dart puck 760 is shown in more detail in FIG. 7B. Dart puck 760 may be made of a material (e.g., metal, steel) capable to resist the detonation in the upstream perforating gun assembly 350 and to not deform due to the pressure wave generated because of the detonation. Dart puck 760 has a body 761 that accommodates a dart 762 in an internal chamber 764. A retaining nut 768 loosely maintains the dart 762 inside the internal chamber 764. The dart 762 may have the same shape, size and composition as the dart 342 shown in FIGS. 6A-6D. Dart 762 has a tip 762A and a base 762B. The dart 762 works similar to the dart 342, i.e., the tip 762A is located in a conduit 770 and the base 762B is located in the internal chamber 764. When a detonation takes place in the upstream perforating gun assembly 350, the dart 762 blocks the conduit 770 formed through the dart puck 760.

Note that FIG. 7A shows the dart puck 760 being in direct mechanical contact with both (1) an end plate 356 of the gun carrier 354 and (2) the end 300B of the switch sub 300. The dart puck 760 may have one or more grooves 772 located between the dart puck 760 and a barrel portion of the perforating gun assembly 350 for receiving o-rings, for sealing. An additional groove 774 may be formed in the dart puck 760, facing the end 300B of the switch sub 300, also for sealing. Dart puck 760 may also have a thread 776 formed on a projection that faces the switch sub 300 and partially enters inside the switch sub 300. No mating thread is formed in the switch sub 300. The purpose of the thread 776 formed on the dart puck 760 is for being able to attach a tool to it and remove the dart puck 760 from the inside of the upstream perforating gun assembly 350 when the time to replace the gun 350 has come. Note that due to the blast, it is possible that the dart puck 760 is stuck in the upstream perforating gun assembly 350. By being able to attach a tool to the dart puck 760, the operator of the gun 350 is able to remove the dart puck 760 and reuse it for a next perforation operation, with another gun assembly.

Figure 8A:
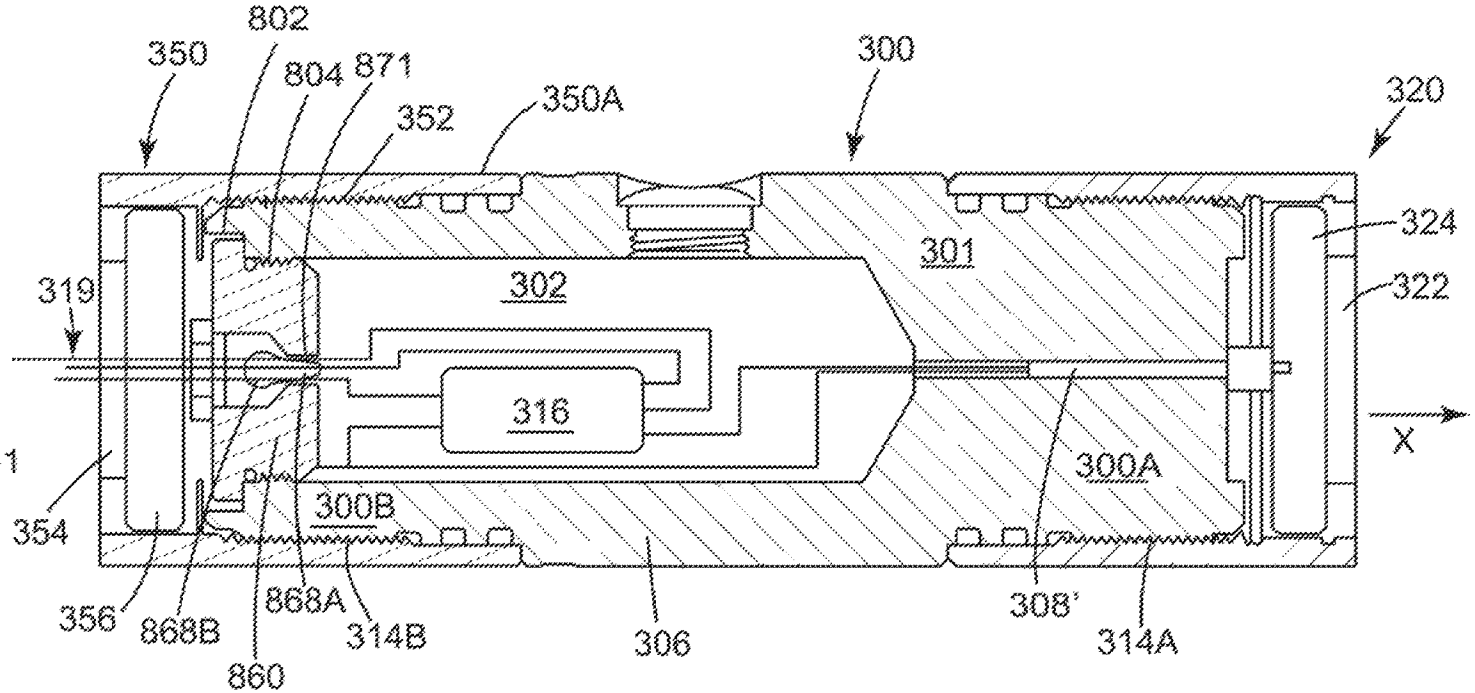
FIG. 8A illustrates a dart puck attached to a switch sub and FIG. 8B illustrates a dart located inside the dart puck.
Figure 8B:
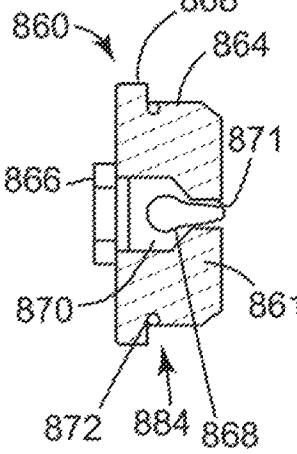

In still another embodiment, as illustrated in FIGS. 8A and 8B, another dart puck is used, but this dart puck attaches to the switch sub and is disposed entirely inside the switch sub, so that no special perforating gun assembly or adapter is necessary. In other words, a traditional perforating gun assembly directly attaches to the switch sub for this embodiment. However, in this embodiment, the switch sub needs to be specially manufactured to receive the dart puck as now discussed.

FIG. 8A shows the end 300B of the switch sub 300 being machined to have a slot 802 and a thread 804. Dart puck 860 has a body 861 (shown individually in FIG. 8B) that includes a lip 868 that fits into slot 802, and optionally a thread 864 that mates with thread 804. A retaining nut 866 screws into the body 861 of the dart puck 860 for loosely maintaining dart 868 inside internal chamber 870. Chamber 870 is formed in the body of the dart puck 860 and communicates through a conduit 871 with the internal chamber 302 of the switch sub 300. Dart 868 has a tip portion 868A that fits inside the conduit 871 and a base portion 868B that is located inside the internal chamber 870. One or more wires 319 may be disposed next to the dart 868 or passing through the dart 868, as discussed in the embodiments illustrated in FIGS. 6A-6D. Dart puck 860 may have a groove 872 that holds an o-ring 874 for better sealing the internal chamber 302 of the switch sub 300 from the upstream perforating gun assembly 350. Note that FIG. 8A shows an electronic device 308' that may be different from the igniter 308 shown in FIG. 3.

In one embodiment, lip 868 is fully located inside slot 802, i.e., it is fully located inside the switch sub 300. To remove or attach the dart puck 860 to the switch sub 300, the internal chamber 870 may be formed to have a specific internal shape (e.g., hex shape) so that a dedicated tool may be inserted into the chamber to screw or unscrew the dart puck 860. Alternatively, notches may be formed in the lip 868 for allowing a dedicated tool to engage the dart puck 860.

Figure 9:
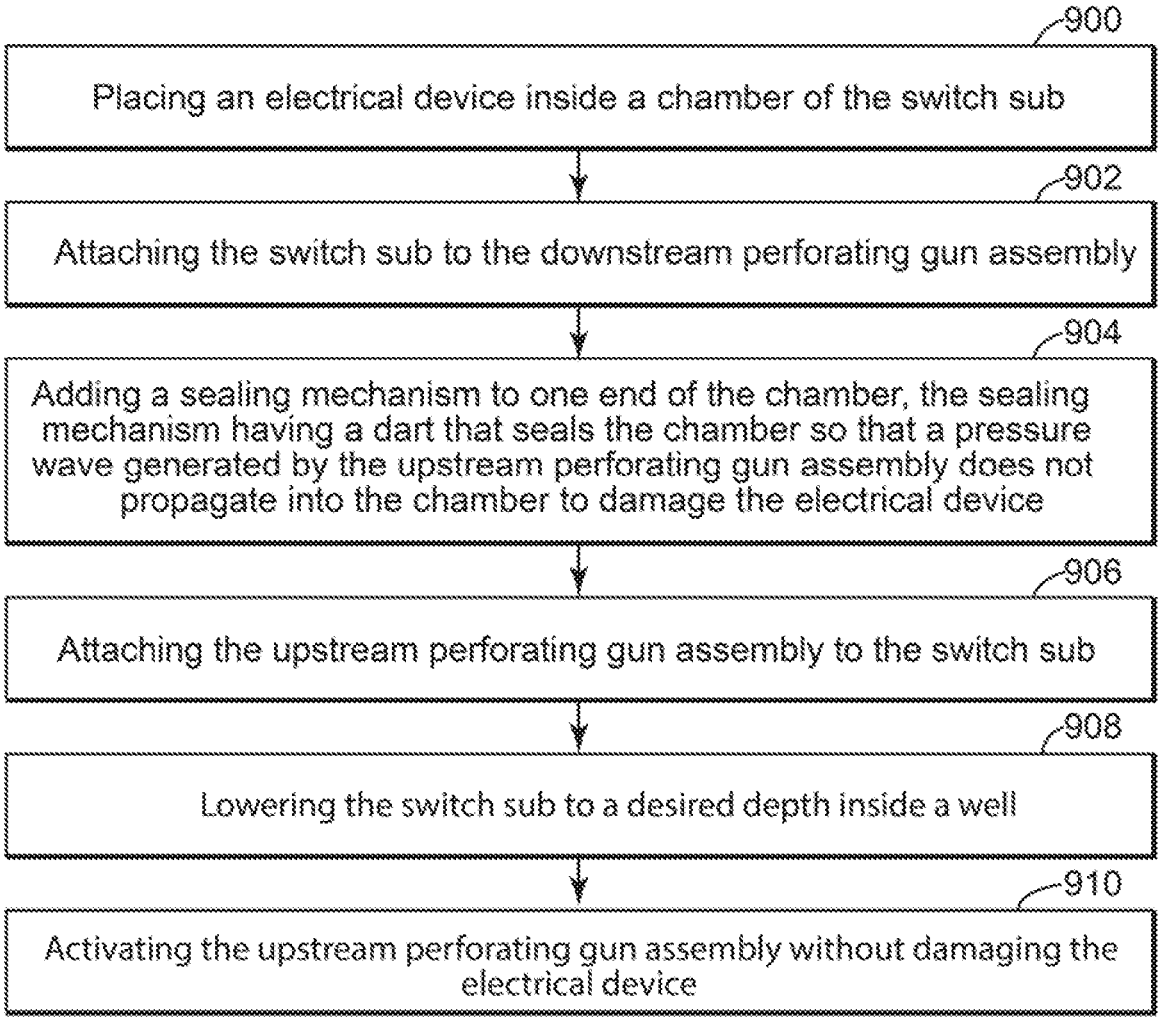
FIG. 9 is a flowchart of a method for using a switch sub connected between two perforating gun assemblies, the switch sub being sealed at both ends from pressure waves generated by the gun assemblies.

A method of using a switch sub that protects inside electronics from damage from both upstream and downstream directions is now discussed with regard to FIG. 9. The method includes a step 900 of placing an electrical device 316 inside a chamber 302 of the switch sub 300, a step 902 of attaching the switch sub 300 to the downstream perforating gun assembly 320, a step 904 of adding a sealing mechanism 330, 760, or 860 to one end of the chamber 302, the sealing mechanism having a dart 342, 762, or 868 that seals the chamber so that a pressure wave generated by the upstream perforating gun assembly 350 does not propagate into the chamber to damage the electrical device 316, a step 906 of attaching 906 the upstream perforating gun assembly 350 to the switch sub 300, a step 908 of lowering the switch sub and the guns to a desired depth inside a well, and a step 910 of activating the upstream perforating gun assembly 350 without damaging the electrical device 316.

The disclosed embodiments provide methods and systems for preventing electronics located inside a switch sub from being damaged by a detonation of an adjacent perforating gun assembly. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A perforating gun assembly, comprising:

an upstream perforating gun comprising a first end, a second opposing end, and a tubular barrel forming an internal gun barrel chamber;

a downstream perforating gun comprising a first end, a second opposing end, and a tubular barrel also forming an internal gun barrel chamber;

a switch sub comprising a first end, a second opposing end, and a bore there between forming an internal sub chamber, wherein:

the switch sub resides between the downstream perforating gun and the upstream perforating gun;

an electrical switch residing within the internal sub chamber;

two or more detonator wires extending from the electrical switch, through the internal sub chamber, and into the internal gun barrel chamber of the upstream perforating gun;

a dart puck residing at the first end of the switch sub, comprising:

a generally tubular body residing between the internal gun barrel chamber of the upstream perforating gun and the internal sub chamber, with the tubular body threadedly connecting the upstream perforating gun and the switch sub, and residing at least partially within the second end of the first perforating gun; and a central conduit that receives the two or more detonator wires as the detonator wires move from the internal sub chamber to the internal gun barrel chamber of the upstream perforating gun;

a dart having a tip part extending partially into the central conduit, and a base part loosely residing between the tubular body and the internal gun barrel chamber of the upstream perforating gun, a retaining nut residing between the body of the dart puck and the internal gun barrel chamber of the upstream perforating gun and retaining the dart within the dart plug; and an end plate residing within the internal gun barrel chamber of the first perforating gun proximate the retaining nut, oriented transverse to a longitudinal axis of the internal gun barrel chamber;

and wherein:

the dart is fabricated from a soft metal that deforms under pressure so that at least a portion of the base part squeezes onto the central conduit in response to a pressure wave generated by charges associated with the upstream perforating gun during detonation, thereby sealing off the switch sub and insulating the internal sub chamber and the electrical switch from fluid and debris, and the end plate mitigates the pressure wave against the dart.

2. The perforating gun assembly of claim 1, wherein:

an exterior diameter of the tip part of the dart is smaller than an exterior diameter of the base part of the dart; and the base part of the dart has a diameter larger than a diameter of the central conduit so that the base part does not fit inside the central conduit.

3. The perforating gun assembly of claim 2, wherein the dart is not electrically connected to the one or more wires.

4. The perforating gun assembly of claim 2, wherein the dart has a conduit through which the one or more wires pass within the central conduit.

5. The perforating gun of claim 1, wherein the body of the dart puck extends at least partially into the switch sub.

6. An assembly for protecting an internal chamber of a switch sub from a blast of an upstream perforating gun within a wellbore, the assembly comprising:

a switch sub having a first end threadedly connected to the upstream perforating gun, a second end opposite the first end threadedly connected to a downstream perforating gun, and an internal sub chamber between the first and second ends;

an electrical switch residing within the internal sub chamber;

two or more detonator wires in electrical communication with the electrical switch;

a slab having a through passage, the slab slidably residing within the second end of the upstream perforating gun and abutting the first end of the switch sub;

a projectile loosely located along the slab, wherein the projectile comprises:

a tip extending at least partially into the through passage, and a base residing proximate the through passage, and a retaining nut residing between the slab and the upstream perforating gun, wherein the retaining nut partially closes off the through passage but retains the projectile, and receives the two or more detonator wires;

and wherein:

the two or more detonator wires pass from the switch sub and through the through passage of the slab up to the first perforating gun, and the projectile is fabricated from a compliant material that deforms under pressure so that at least a portion of the base squeezes onto the through passage to seal the through passage in response to a pressure wave generated by detonation of charges associated with the upstream perforating gun, and thereby insulating the electrical switch from fluid and debris.

7. The assembly of claim 6, wherein the slab has an internal chamber that houses the base part of the projectile opposite the internal sub chamber of the switch sub.

8. The assembly of claim 7, wherein:

the projectile is a dart; and the projectile is located in its entirety inside the slab.

* * * * *